US010035680B2

(12) United States Patent
Richter et al.

(10) Patent No.: US 10,035,680 B2
(45) Date of Patent: Jul. 31, 2018

(54) ELEVATOR SAFETY CIRCUIT INCLUDING NON FORCED GUIDED RELAY

(71) Applicant: OTIS ELEVATOR COMPANY, Farmington, CT (US)

(72) Inventors: Jochen Thomas Richter, Berlin (DE); Hebert Horbrügger, Berlin (DE); Richard F. Magda, Plantsville, CT (US); Marvin Dehmlow, Berlin (DE)

(73) Assignee: OTIS ELEVATOR COMPANY, Farmington, CT (US)

( * ) Notice: Subject to any disclaimer, the term of this patent is extended or adjusted under 35 U.S.C. 154(b) by 396 days.

(21) Appl. No.: 14/767,388

(22) PCT Filed: Feb. 14, 2013

(86) PCT No.: PCT/US2013/026033
§ 371 (c)(1),
(2) Date: Aug. 12, 2015

(87) PCT Pub. No.: WO2014/126562
PCT Pub. Date: Aug. 21, 2014

(65) Prior Publication Data

US 2016/0002005 A1 Jan. 7, 2016

(51) Int. Cl.
*B66B 1/34* (2006.01)
*B66B 5/00* (2006.01)
(Continued)

(52) U.S. Cl.
CPC ..... *B66B 5/0031* (2013.01); *B66B 1/30* (2013.01); *B66B 1/32* (2013.01); *B66B 5/02* (2013.01); *B66B 13/22* (2013.01)

(58) Field of Classification Search
CPC ..... B66B 5/0031; B66B 1/30; B66B 1/32; B66B 5/02; B66B 13/22
USPC ..... 187/247, 288, 289, 293, 316, 317, 187/391–393; 49/26, 28; 361/30, 79; 318/454, 455, 474, 478, 479
See application file for complete search history.

(56) References Cited

U.S. PATENT DOCUMENTS 5,020,640 A * 6/1991 Nederbragt ..... B66B 1/32 187/288
5,107,964 A 4/1992 Coste et al.
(Continued)

FOREIGN PATENT DOCUMENTS

| | | | |
|---|---|---|---|
| CN | 1220619 | C | 9/2005 |
| KR | 1020110022055 | A | 3/2011 |
| WO | 2012141713 | A1 | 10/2012 |

OTHER PUBLICATIONS

International Search Report for application PCT/US2013/026033, dated Oct. 24, 2013, 5 pages.
(Continued)

*Primary Examiner* — Anthony Salata
(74) *Attorney, Agent, or Firm* — Cantor Colburn LLP

(57) ABSTRACT

An elevator safety circuit includes a plurality of relays; safety logic for monitoring status of the plurality of relays, the safety logic generating an output signal in response to the status of the plurality of relays; and a processor controlling operation of an elevator drive in response to the output signal; wherein at least one of the relays is a forced guided relay and at least one of the relays is other than a forced guided relay.

14 Claims, 3 Drawing Sheets

(51) Int. Cl.

| | |
|---|---|
| ***B66B 1/30*** | (2006.01) |
| ***B66B 1/32*** | (2006.01) |
| ***B66B 5/02*** | (2006.01) |
| ***B66B 13/22*** | (2006.01) |

(56) References Cited

U.S. PATENT DOCUMENTS

| | | | | |
|---|---|---|---|---|
| 5,407,028 | A | 4/1995 | Jamieson et al. | |
| 6,056,088 | A * | 5/2000 | Gerstenkorn | B66B 5/0031 187/390 |
| 6,446,760 | B1 * | 9/2002 | Lisi | B66B 5/0031 187/391 |
| 7,353,916 | B2 * | 4/2008 | Angst | B66B 5/02 187/314 |
| 7,575,102 | B2 | 8/2009 | Matsuoka | |
| 7,775,327 | B2 * | 8/2010 | Abraham | B66B 1/308 187/288 |
| 7,896,138 | B2 * | 3/2011 | Syrman | B66B 5/0031 187/289 |
| 8,584,812 | B2 * | 11/2013 | Dorsch | B66B 5/0031 187/287 |
| 8,585,158 | B2 * | 11/2013 | Gewinner | H02M 3/33523 303/199 |
| 8,997,941 | B2 * | 4/2015 | Abad | B66B 13/22 187/247 |
| 9,061,863 | B2 * | 6/2015 | Birrer | B66B 13/22 |
| 9,617,117 | B2 * | 4/2017 | Rogers | B66B 5/0031 |
| 9,776,829 | B2 * | 10/2017 | Kattainen | B66B 1/32 |
| 2003/0102199 | A1 | 6/2003 | Neumann et al. | |
| 2007/0187185 | A1 | 8/2007 | Abraham et al. | |
| 2015/0166303 | A1 * | 6/2015 | Puranen | B66B 13/22 187/277 |

OTHER PUBLICATIONS

Written Opinion for application PCT/US2013/026033, dated Oct. 24, 2013, 6 pages.

Chinese Office Action and Search Report for application CN 201380075621.X, dated Jul. 26, 2016, 13 pages.

European Search Report for application EP 13874886.8, dated Sep. 6, 2016, 7 pages.

* cited by examiner

ELEVATOR SAFETY CIRCUIT INCLUDING NON FORCED GUIDED RELAY

FIELD OF INVENTION

The subject matter disclosed herein relates generally to the field of elevator systems, and more particularly, to a safety circuit for an elevator system.

BACKGROUND

Elevator systems may include safety circuits to control operation of the elevator systems in a predefined manner. U.S. Pat. No. 5,407,028 discloses an exemplary elevator safety circuit that employs a number of relays to provide power to an elevator brake and elevator motor. Existing safety circuits employ forced guided relays to apply or interrupt power to elevator components, such as a brake or motor. Forced guided relays have contacts that are mechanically linked, so that all contacts are ensured to move together. Forced guided relays are typically more expensive than other relays lacking a mechanical connection between relay contacts. Also, forced guided relays are typically larger than other relays lacking a mechanical connection between relay contacts.

BRIEF SUMMARY

According to an exemplary embodiment, an elevator safety circuit includes a plurality of relays; safety logic for monitoring status of the plurality of relays, the safety logic generating an output signal in response to the status of the plurality of relays; and a processor controlling operation of an elevator drive in response to the output signal; wherein at least one of the relays is a forced guided relay and at least one of the relays is other than a forced guided relay.

Other aspects, features, and techniques of embodiments of the invention will become more apparent from the following description taken in conjunction with the drawings.

BRIEF DESCRIPTION OF THE DRAWINGS

Referring now to the drawings wherein like elements are numbered alike in the FIGURES.

DETAILED DESCRIPTION

Figure 1:
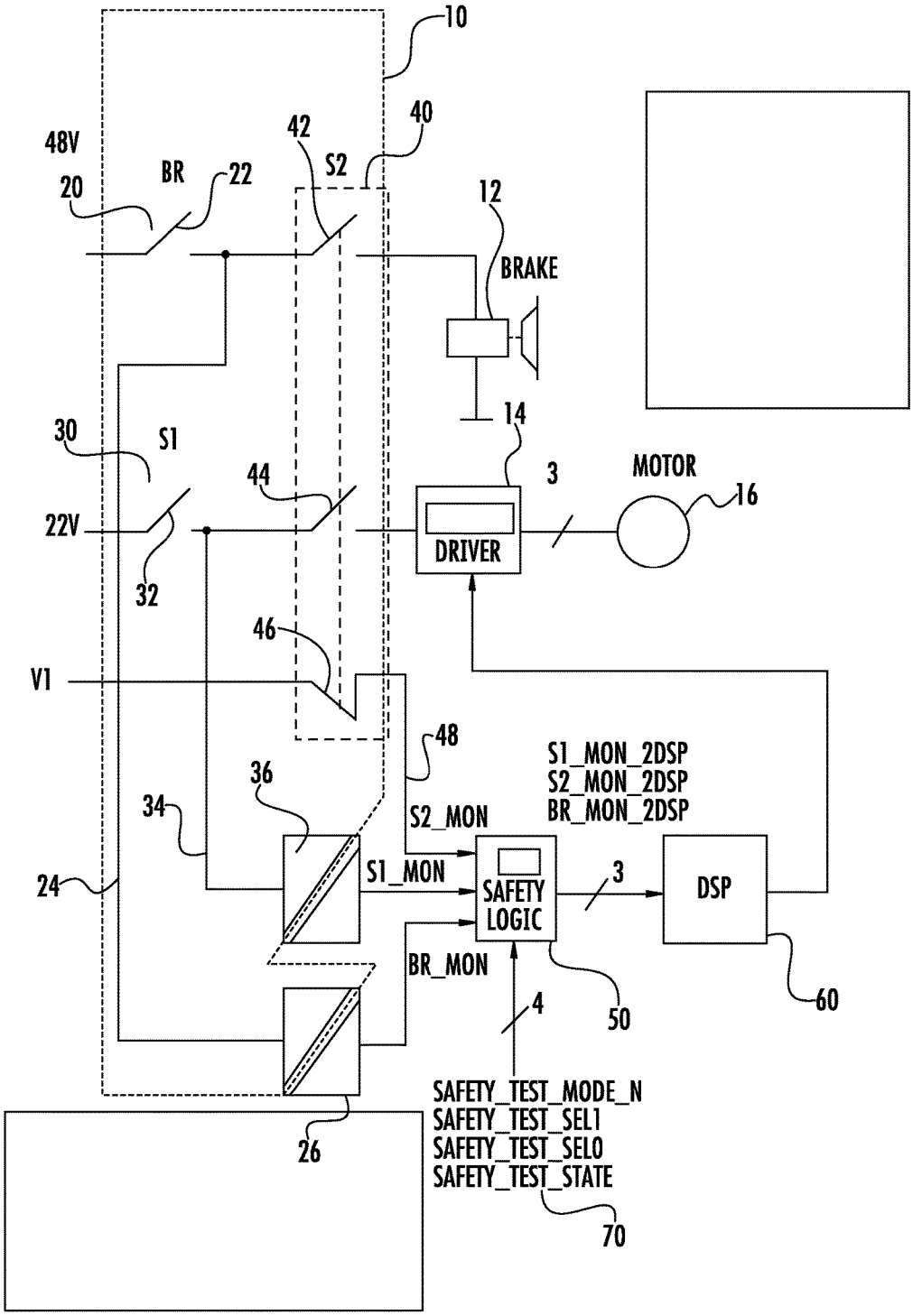
FIG. 1 depicts an elevator safety circuit in a standstill condition in an exemplary embodiment.

FIG. 1 depicts an elevator safety circuit 10 in an exemplary embodiment. Elevator safety circuit 10 applies or interrupts power to an elevator brake 12 (e.g., on an elevator car or drive unit) and an elevator drive 14. Elevator drive 14 provides power (e.g., 3 phase power) to elevator motor 16 to impart motion to an elevator car.

Elevator safety circuit 10 includes a brake relay 20 that applies or interrupts power to brake 12. Brake relay 20 is other than a forced guided relay. Elevator safety circuit 10 includes a drive relay 30 that applies or interrupts power to drive 14. Drive relay 30 is other than a forced guided relay. Elevator safety circuit 10 includes a safety relay 40. Safety relay 40 includes three contacts, 42, 44 and 46, connections to which are described in further detail herein. Safety relay 40 is a forced guided relay, meaning that contacts 42, 44 and 46 are mechanically linked to move together.

Brake relay 20 includes a contact 22 connected to a first contact 42 of safety relay 40. Power to the brake 12 is applied through contact 22 and first contact 42. Drive relay 30 includes a contact 32 connected to a second contact 44 of safety relay 40. Power to the drive 14 is applied through contact 32 and second contact 44. Third contact 46 of safety relay 40 is connected to a reference voltage V1, which may be a ground, logic one (e.g., 5 volts), etc.

The states of brake relay 20, drive relay 30 and safety relay 40 are monitored in order to determine if the system is in a proper state to operate an elevator car. Safety logic 50 receives monitoring signals from each of the brake relay 20, drive relay 30 and safety relay 40. A connection 24 is provided from a location in brake relay 20 to safety logic 50. The connection 24 may include a coupler 26, convert the voltage of a brake relay monitoring signal from brake relay 20 (e.g., 48 volts) to a level suitable for safety logic 50 (e.g., 5 volts). Coupler 26 may be an opto-coupler or other known type of device. In operation, when contact 22 is closed, the brake relay monitoring signal will indicate this state to the safety logic 50 (e.g., a 5 volt signal is provided to safety logic 50). When contact 22 is open, the brake relay monitoring signal is not provided to safety logic 50.

A connection 34 is provided from a location in drive relay 30 to safety logic 50. The connection 34 may include a coupler 36, convert the voltage of a drive relay monitoring signal from drive relay 30 (e.g., 22 volts) to a level suitable for safety logic 50 (e.g., 5 volts). Coupler 36 may be an opto-coupler or other known type of device. In operation, when contact 32 is closed, the drive relay monitoring signal will indicate this state to the safety logic 50 (e.g., a 5 volt signal is provided to safety logic 50). When contact 32 is open, the drive relay monitoring signal is not provided to safety logic 50.

A connection 48 is provided from a location in safety relay 40 to safety logic 50. At standstill, when contact 46 is closed, a safety relay monitoring signal will indicate this state to the safety logic 50 (e.g., a reference voltage V1 signal is provided to safety logic 50). This indicates that contact 42 and 44 are opened. When contact 46 is open, the safety relay monitoring signal is not provided to safety logic 50.

Safety logic 50 receives the brake relay monitoring signal, drive relay monitoring signal and safety relay monitoring signal and generates an output signal. The safety logic 50 may include logic gates (e.g., AND, OR, NOR) to generate a three-bit output signal that is provided to a processor 60. Processor 60 controls operation of the elevator system based on the output signal from the safety logic 50. For example, processor 60 may prevent starting of motor 16 if one of brake relay 20, drive relay 30 or safety relay 40 has not closed. Further, processor 60 may prevent starting of motor 16 if one of brake relay 20, drive relay 30 or safety relay 40 has not opened after an elevator run.

Safety logic 50 may also be placed into a test mode so that test signals may be applied to the safety logic 50, and the resultant output signal monitored. FIG. 1 depicts test signals 70 applied to safety logic 50. The output of the safety logic 50 can then be checked to ensure proper operation. This may be performed periodically (e.g., once a year) as part of an inspection process.

Figure 2A:
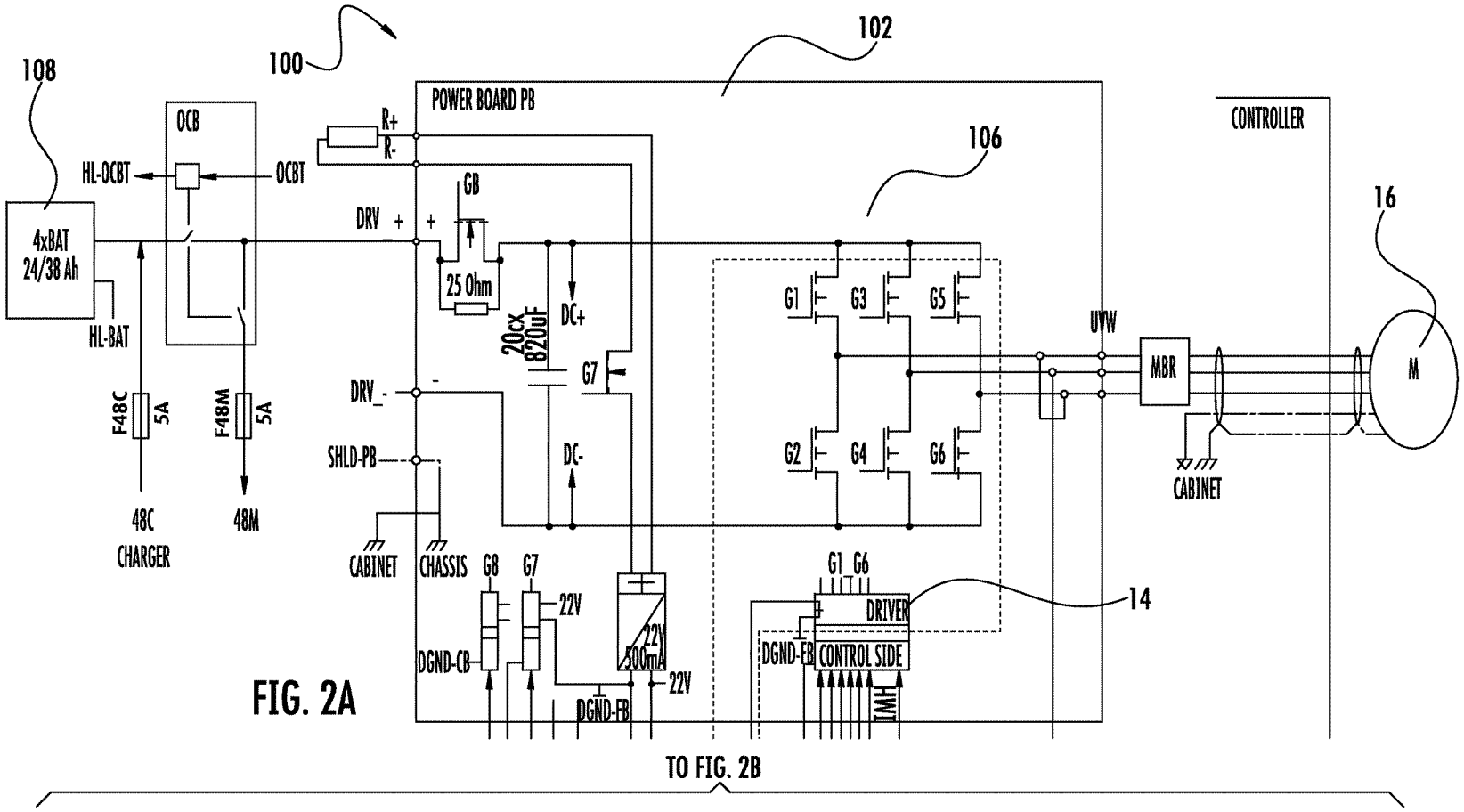
FIGS. 2*a*, 2*b* depicts a drive unit including the safety circuit of FIG. 1 in an exemplary embodiment.
Figure 2B:
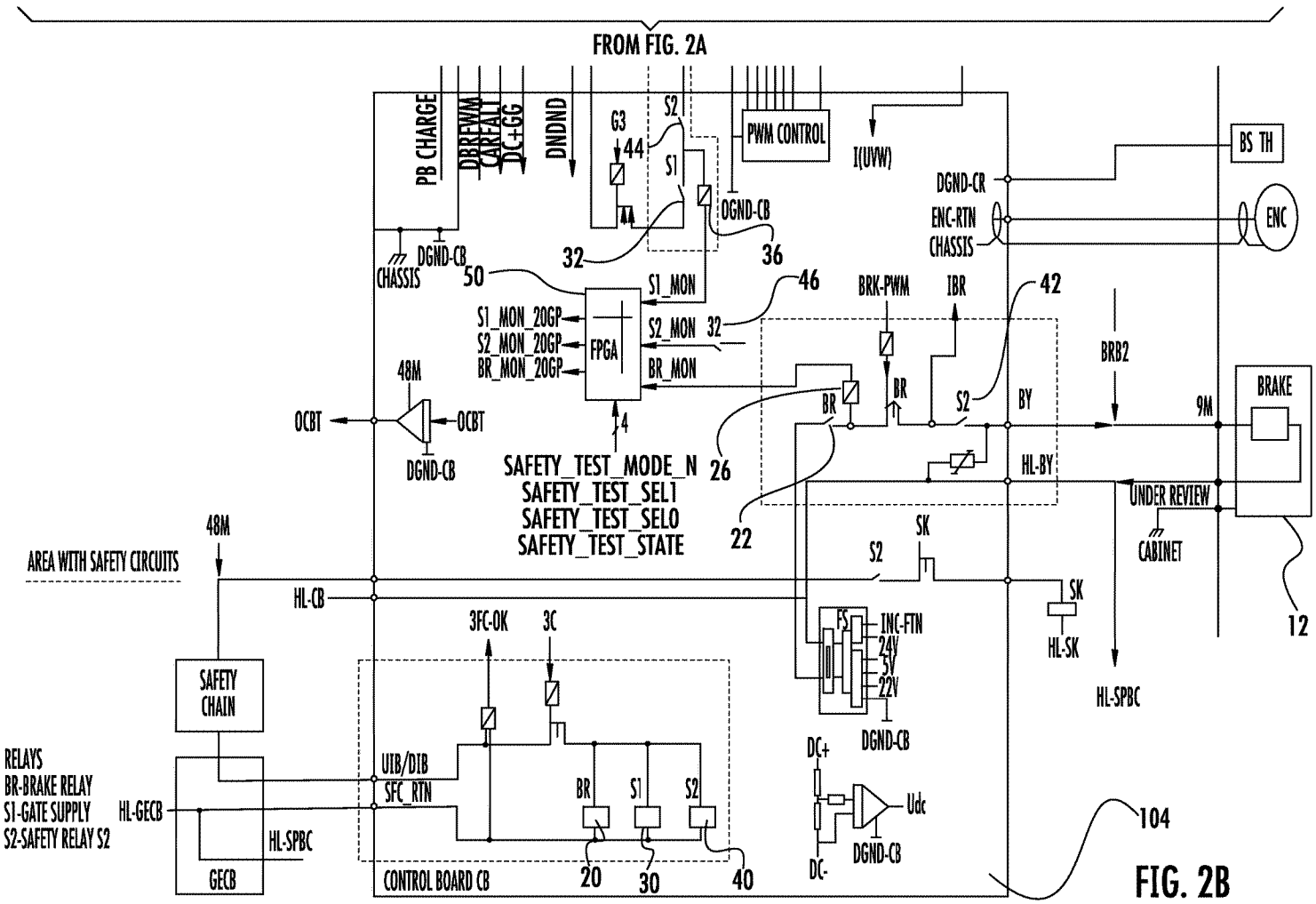

FIGS. 2*a*, 2*b* depicts a drive unit 100 including the safety circuit 10 of FIG. 1 in an exemplary embodiment. Drive unit 100 includes a power board 102 and a control board 104. Power board 102 includes drive 14 that controls a converter 106. Converter 106 includes switches that convert DC power from battery 108 to AC power to drive motor 16 in motoring mode. Conversely, converter 106 converts AC power from motor 16 to DC power to charge battery 108 in regenerative mode.

Safety circuit 10 is located on control board 104. Brake relay 20, drive relay 30 and safety relay 40 are represented as a safety chain on control board 104. Safety logic 50 is also positioned on control board 104, along with couplers 26 and 36. Brake relay contact 22, drive relay contact 32, and safety relay contacts 42, 44 and 46 are also on control board 104. As described above with reference to FIG. 1, safety logic 50 uses the brake relay monitoring signal, drive relay monitoring signal and safety relay monitoring signal to enable and disable operation of the drive unit 100.

Several advantages are provided by using relays other than forced guided relays. Brake relay 20 and drive relay 30 are smaller in physical size than safety relay 40, reducing the overall size of the safety circuit 10, as compared to safety circuits employing all forced guided relays. Brake relay 20 and drive relay 30 may be surface mount devices. Further, the cost of safety circuit 10 is reduced, as compared to using all forced guided relays.

The terminology used herein is for the purpose of describing particular embodiments only and is not intended to be limiting of the invention. While the description of the present invention has been presented for purposes of illustration and description, it is not intended to be exhaustive or limited to the invention in the form disclosed. Many modifications, variations, alterations, substitutions, or equivalent arrangement not hereto described will be apparent to those of ordinary skill in the art without departing from the scope and spirit of the invention. Additionally, while the various embodiments of the invention have been described, it is to be understood that aspects of the invention may include only some of the described embodiments. Accordingly, the invention is not to be seen as being limited by the foregoing description, but is only limited by the scope of the appended claims. Features shown with one embodiment may be used with any other embodiment even if not described with the other embodiments.

What is claimed is:

1. An elevator safety circuit comprising:

a plurality of relays;

safety logic for monitoring status of the plurality of relays, the safety logic generating an output signal in response to the status of the plurality of relays; and a processor controlling operation of an elevator drive in response to the output signal;

wherein at least one of the relays is a forced guided relay and at least one of the relays is other than a forced guided relay.

2. The elevator safety circuit of claim 1 wherein:

the plurality of relays include a brake relay and a safety relay, the safety relay being a forced guided relay and the brake relay being other than a forced guided relay.

3. The elevator safety circuit of claim 2 further comprising:

a connection between the brake relay and the safety logic to provide a brake relay monitoring signal to the safety logic, the safety logic generating the output signal in response to the brake relay monitoring signal.

4. The elevator safety circuit of claim 2 wherein:

the brake relay and a first contact of the safety relay apply or interrupt power to an elevator brake.

5. The elevator safety circuit of claim 2 wherein:

the plurality of relays include a drive relay, the drive relay being other than a forced guided relay.

6. The elevator safety circuit of claim 5 further comprising:

a connection between the drive relay and the safety logic to provide a drive relay monitoring signal to the safety logic; and a second connection between the brake relay and the safety logic to provide a brake relay monitoring signal to the safety logic;

the safety logic generating the output signal in response to the drive relay monitoring signal and the brake relay monitoring signal.

7. The elevator safety circuit of claim 5 wherein:

the drive relay and a second contact of the safety relay apply or interrupt power to an elevator drive.

8. The elevator safety circuit of claim 6 further comprising:

a third connection between the safety relay and the safety logic to provide a safety relay monitoring signal to the safety logic, the safety logic generating the output signal in response to the drive relay monitoring signal and the brake relay monitoring signal safety relay monitoring signal.

9. The elevator safety circuit of claim 2 wherein:

the brake relay is smaller in physical size than the safety relay.

10. The elevator safety circuit of claim 1 wherein:

the plurality of relays include a drive relay and a safety relay, the safety relay being a forced guided relay and the drive relay being other than a forced guided relay.

11. The elevator safety circuit of claim 10 further comprising:

a connection between the drive relay and the safety logic to provide a drive relay monitoring signal to the safety logic, the safety logic generating the output signal in response to the drive relay monitoring signal.

12. The elevator safety circuit of claim 10 wherein:

the drive relay and a second contact of the safety relay apply or interrupt power to an elevator drive.

13. The elevator safety circuit of claim 10 wherein:

the drive relay is smaller in physical size than the safety relay.

14. The elevator safety circuit of claim 1 wherein:

the safety logic includes a test mode, the safety logic generating the output signal in response to test signals in the test mode.

* * * * *